US007202830B1

(12) United States Patent
Brown et al.

(10) Patent No.: US 7,202,830 B1
(45) Date of Patent: Apr. 10, 2007

(54) HIGH GAIN STEERABLE PHASED-ARRAY ANTENNA

(75) Inventors: Forrest J Brown, Carson City, NV (US); Forrest Wolf, Reno, NV (US)

(73) Assignee: Pinyon Technologies, Inc., Reno, NV (US)

( * ) Notice: Subject to any disclaimer, the term of this patent is extended or adjusted under 35 U.S.C. 154(b) by 0 days.

(21) Appl. No.: 11/055,490

(22) Filed: Feb. 9, 2005

(51) Int. Cl.
*H01Q 13/10* (2006.01)

(52) U.S. Cl. ..... 343/770; 343/754

(58) Field of Classification Search ..... 343/770, 343/754, 757, 850, 853, 768
See application file for complete search history.

(56) References Cited

U.S. PATENT DOCUMENTS

| | | | | |
|---|---|---|---|---|
| 3,705,283 | A | 12/1972 | Sayer, Jr. | 219/695 |
| 3,764,768 | A | 10/1973 | Sayer, Jr. | 219/695 |
| 5,025,264 | A | 6/1991 | Stafford | 343/767 |
| 5,087,921 | A | 2/1992 | Kurtz | 343/771 |
| 5,119,107 | A | 6/1992 | Wildey et al. | 343/770 |
| 5,189,433 | A * | 2/1993 | Stern et al. | 343/770 |
| 5,347,287 | A | 9/1994 | Speciale | 342/375 |
| 6,130,648 | A * | 10/2000 | Rulf et al. | 343/770 |
| 6,285,337 | B1 * | 9/2001 | West et al. | 343/853 |
| 6,292,133 | B1 * | 9/2001 | Lynch | 342/368 |
| 6,388,621 | B1 * | 5/2002 | Lynch | 343/700 MS |
| 6,456,241 | B1 * | 9/2002 | Rothe et al. | 343/700 MS |
| 6,611,231 | B2 | 8/2003 | Crilly, Jr. et al. | 342/378 |
| 2002/0021255 | A1 * | 2/2002 | Zhang et al. | 343/770 |
| 2002/0171594 | A1 * | 11/2002 | Fang | 343/767 |
| 2003/0184477 | A1 * | 10/2003 | Shafai et al. | 343/700 MS |
| 2005/0146479 | A1 * | 7/2005 | Stenger et al. | 343/772 |
| 2005/0162328 | A1 * | 7/2005 | Mori | 343/770 |
| 2005/0259019 | A1 * | 11/2005 | Miles | 343/754 |

FOREIGN PATENT DOCUMENTS

| | | |
|---|---|---|
| EP | 0 384 777 A2 | 8/1990 |
| EP | 0 384 777 A3 | 8/1990 |
| EP | 0 384 780 A2 | 8/1990 |
| EP | 0 384 780 A3 | 8/1990 |
| WO | WO 2006/086180 A2 | 8/2006 |

OTHER PUBLICATIONS

Brown, et al., "A GPS Digital Phased Array Antenna and Receiver", Proceedings of IEEE Phased Array Symposium, Dana Point, CA, May 2000, 4 pages.

(Continued)

*Primary Examiner*—Trinh Dinh
*Assistant Examiner*—Tung Le
(74) *Attorney, Agent, or Firm*—Jackson & Co., LLP; Andrew V. Smith

(57) ABSTRACT

A high gain, steerable phased array antenna includes multiple oblong slots. For each of the oblong and preferably rectangular slots, an electrical microstrip feed line is disposed within a parallel plane to the slot, and extends in the short dimension of the slot across the center of its long dimension. The microstrip feed lines and corresponding oblong slots form magnetically coupled LC resonance elements. A main feed line couples with the microstrip feed lines. Delay circuitry is used to electronically steer the antenna by selectively changing signal phases on the microstrip feed lines. One or more processors operating based on program code continuously or periodically determine a preferred signal direction and control the delay circuitry to steer the antenna in the preferred direction. The preferred signal direction is determined based on a directional throughput determination.

86 Claims, 11 Drawing Sheets

OTHER PUBLICATIONS

Agile Phased Array Antenna, by Roke Manor Research, 2002, 2 pages.

Galdi, et al., "Cad of Coaxially End-Fed Waveguide Phased-Array Antennas", Microwave and Optical Technology Letters, vol. 34, No. 4, Aug. 20, 2002, pp. 276-281.

"PCT Notification of Transmittal of the International Search Report and the Written Opinion of the International Searching Authority, or the Declaration", for PCT Application No. PCT/US2006/003334, filed Jan. 30, 2006, 13 pages.

* cited by examiner

Micro strip feed line to slot attachment point the line printed circuit board to this point.

Micro strip feed line to slot attachment point the line printed circuit board to this point.

HIGH GAIN STEERABLE PHASED-ARRAY ANTENNA

BACKGROUND

Conventional phased array antennas incorporate waveguide technology with the antenna elements. A waveguide is a device that controls the propagation of an electromagnetic wave so that the wave is forced to follow a path defined by the physical structure of the guide. Waveguides, which are useful chiefly at microwave frequencies in such applications as connecting the output amplifier of a radar set to its antenna, typically take the form of rectangular hollow metal tubes but have also been built into integrated circuits. A waveguide of a given dimension will not propagate electromagnetic waves lower than a certain frequency (the cutoff frequency). Generally speaking, the electric and magnetic fields of an electromagnetic wave have a number of possible arrangements when the wave is traveling through a waveguide. Each of these arrangements is known as a mode of propagation. It is desired to have a phased array antenna that provides enhanced gain characteristics. It is also desired to have a phased array antenna system with a more efficient means for determining and controlling the antenna to be steered according to a most desired directionality.

SUMMARY OF THE INVENTION

A high gain, steerable phased array antenna includes a board or conducting sheet having multiple slots. For each of the slots, an electrical microstrip feed line is disposed within a parallel plane to the slot. The microstrip feed lines and corresponding slots form magnetically coupled LC resonance elements. A main feed line couples with the microstrip feed lines. Delay circuitry is used to electronically steer the antenna by selectively changing signal phases on the microstrip feed lines. One or more processors operating based on program code continuously or periodically determine a preferred signal direction and control the delay circuitry to steer the antenna in the preferred direction. Preferably the slots are oblong or rectangular. The microstrip feed lines preferably extend in the short dimensions of the slots.

A method of operating a high gain, steerable phased array antenna is also provided. The method includes electronically steering the above-described antenna by controlling the delay circuitry, continuously or periodically determining a preferred signal direction, and controlling the delay circuitry to selectively change signal phases on the microstrip feed lines and thereby steer the antenna in the preferred direction.

A further high gain, steerable phased array antenna is also provided, along with a corresponding method of operating it. The antenna includes multiple resonant elements and a main feed coupling with the resonant elements. Electronics are used for steering the antenna by providing different inputs to the resonant elements. One or more processors operating based on program code continuously or periodically determine a preferred signal direction based on a directional throughput determination, and control the electronics to steer the antenna in the preferred direction. The resonant elements are preferably oblong or rectangular slots defined in a board.

The antenna signal preferably includes multiple discreet lobes extending in different directions away from the antenna. The lobes are preferably selected by controlling the electronics based on the directional throughput determination.

The directional throughput determination may include monitoring the throughput of an initial selected lobe, and when the throughput drops below a threshold value, or drops a predetermined percentage amount, or becomes a predetermined amount above a noise level, or combinations thereof, then changing to an adjacent lobe and similarly monitoring its throughput. When the adjacent lobe is determined to have a throughput that is below a threshold value, or is at least a predetermined percentage amount below a maximum value, or is below a predetermined amount above a noise level, or combinations thereof, then the selected lobe is changed to the other adjacent lobe on the opposite side of the initial selected lobe. The directional throughput determination may also include scanning through and determining the throughputs of all or multiple ones of the lobes, wherein the lobe with the highest throughput is selected.

One or more processor readable storage devices are also provided having processor readable code embodied thereon. The processor readable code programs one or more processors to perform any of the methods of operating a high gain steerable phased array antenna described herein.

DETAILED DESCRIPTION OF THE PREFERRED EMBODIMENT

Figure 1:
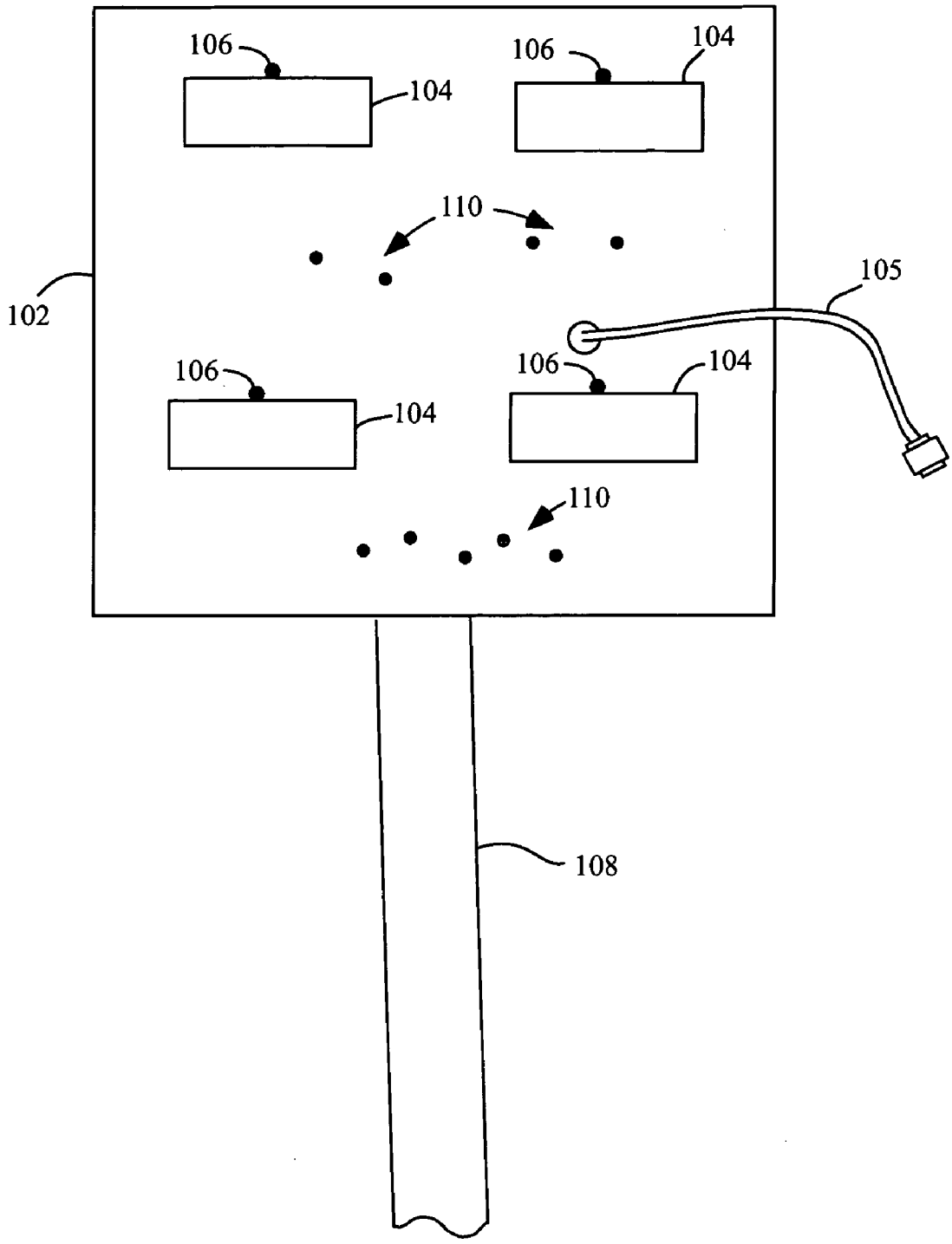
FIG. 1 illustrates a front view of a high gain steerable phased array antenna in accordance with a preferred embodiment.

Referring to FIG. 1, a high gain steerable phased array antenna in accordance with a preferred embodiment includes a conducting sheet 102. The conducting sheet 102 is preferably an area of sheet metal such as copper, and may be composed of one or more of various metals or other conductors. Four slots 104 are cut into the conducting sheet 102. More or fewer slots 104 of arbitrary number may be used, although preferably the slots 104 are arranged in such a manner that they complement each other in a phased array pattern. Each time the number of slots are doubled, the gain is increased by 3 dBi.

The slots 104 are preferably oblong and more preferably rectangular. However, the slots 104 may be square or circular or of an arbitrary shape. The preferred dimension of the sheet is 5⅞" wide by 5⅛" tall. The preferred dimensions of the rectangular slots is ⅝"×2⅛". The dimensions of the slots 104 are generally preferably a half wave ($\lambda/2$) wide and a quarter wave ($\lambda/4$) wave high. The drive impedances of the slots 104 is preferably (60)sq/73=494 ohms. An advantageous gain characteristic is achieved due to the lack of losses in the transition to free space of 377.564 ohms.

A coaxial cable 105 is connected to the sheet 102 preferably by soldering. Although FIG. 2 will show the electrical arrangement of the antenna in more detail, FIG. 1 shows four soldered connections 106 at the middles of long edges of the rectangular slots 104. A signal cable 108 is also shown in FIG. 1, along with a few other solder connections 110 to the sheet 102 from the back side.

Figure 2:
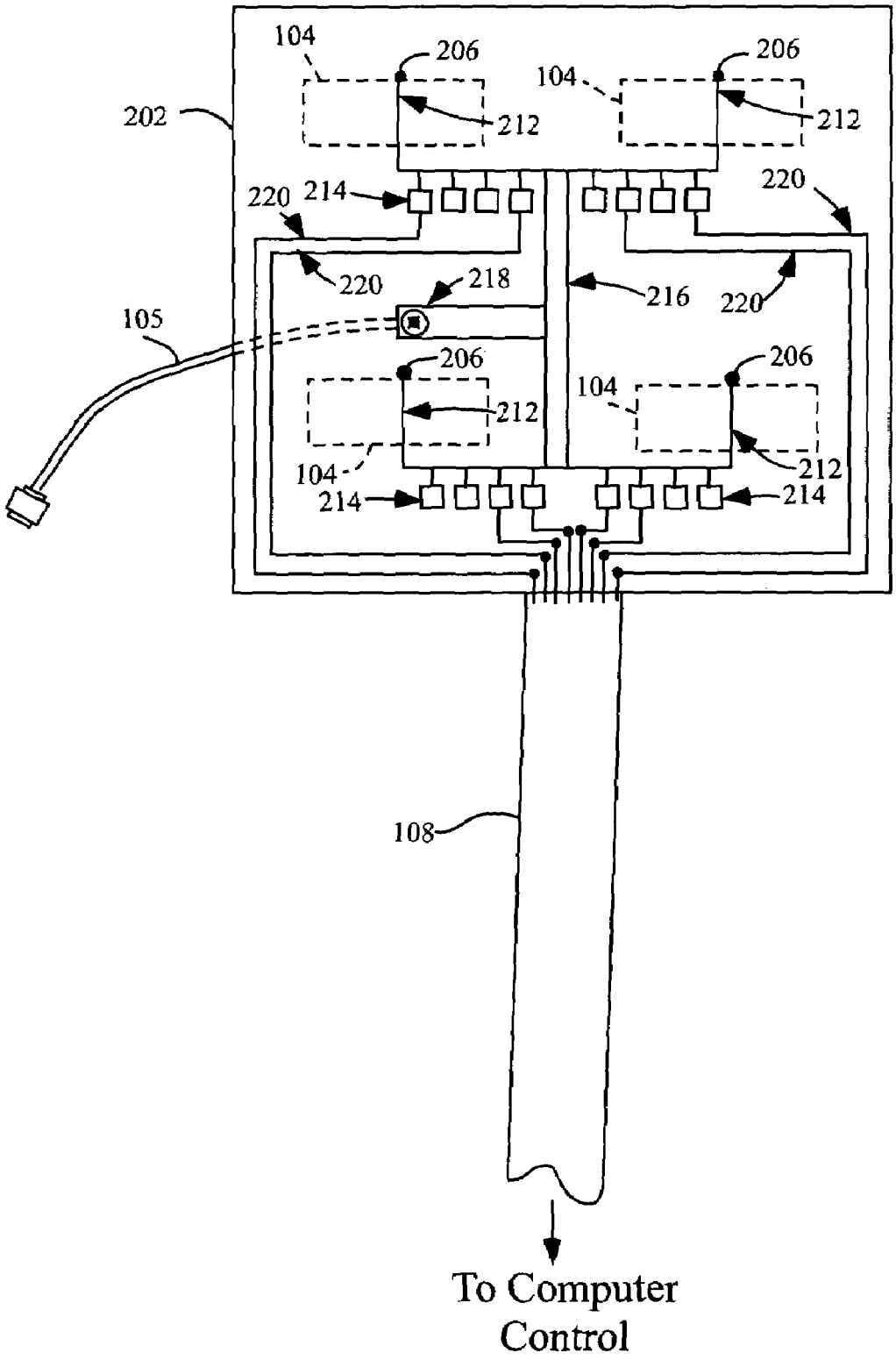
FIG. 2 illustrates a back view of a high gain steerable phased array antenna in accordance with a preferred embodiment.

FIG. 2 illustrates a back side view of a high gain steerable phased array antenna in accordance with a preferred embodiment. This side of the antenna includes a circuit board with various electrical connections. The slots 104 that are cut into the conducting sheet at the front side are shown in dotted lines in FIG. 2 for perspective as to their relative location to the electrical components on the back side. The micro strip feed line connections 206 correspond to the solder connections 106 to the conducting sheet 102 on the front side. These connections 206 are preferably at the centers of the long edges of the oblong and preferably rectangular slots 104. The connections 206 may be alternatively located at the centers of the short edges, or again the slots 104 may be squares or circles or arbitrary shapes.

The slots 104 are resonant by means of a coupling mechanism. The coupling mechanism connects to the resonant slots 104 using microstrip feed lines 212. The microstrip feed lines are constructed on a separate plane of the antenna. The resonant slots 104 are fed in parallel, preferably with 100 ohm microstrip feed lines 212. The microstrip feed lines 212 are shown crossing the short dimensions of the rectangular slots 104 at their centers. The microstrip feed lines 212 are each connected to a series of electronic circuitry components 214. In FIG. 2, each microstrip feed line 212 is has four of these components 214 illustrated as squares. These components 214 include electronic delays that permit the antenna to be directionally steerable. Preferably the components 214 include PIN diodes and inductors. The diodes may be of type diode PIN 60V 100 mA S mini-2P by Panasonic SSG (MFG P/N MA2JP0200L; digikey MA2JP0200LTR-ND). The inductors may be of type 1.0 μH +/−5% 1210 by Panasonic (MFG P/N ELJ-FA1R0JF2; digikey PCD1825TR-ND).

The antenna is electronically steered by adding the delay circuitry 214 to the microstrip feed lines 212. The delay changes the phase of the signal on the microstrip feed lines. The delay circuitry includes the PIN diodes and a pad cut into the copper plane of the circuit board. When the PIN diode is turned on, delay is added to the circuit. This means that it can be used to follow the source of the signal. The signal can originate from a wireless access point, a portable computer, or another device.

The microstrip feed lines 212 each connect to a main feed line 216. The two microstrip feed lines 212 in the upper half of the antenna of FIG. 2 are connected to the upper half of the main feed line 216, and the two microstrip feed lines 212 in the lower half of the antenna of FIG. 2 are connected to the lower half of the main feed line 216. The main feed lines is connected at its center to a coax connection segment 218 that is connected to the coaxial cable 105. Various traces 220 are shown connecting the delay pads 214 to the signal cable 108. The signal cable 108 in turn connects to computer operated control equipment.

The antenna of FIGS. 1–2 has four resonant slots 104. The top and bottom halves of the antenna are mirror images of one another. Two 100 ohm feed lines feed the two resonant slots 104 in the upper half of the antenna shown at FIG. 1. The 100 ohm feed lines are in parallel. The resulting resistance is 50 ohms. This matches the resistance of the 50 ohm main feed line 216. When the lower half of the antenna is taken into account, the center of the antenna is at 25 ohms, i.e., two 50 ohm circuits in parallel. The input impedance of the antenna is selected to be 50 ohms according to the preferred embodiment. An impedance matching pad of 35.35 ohms achieves this.

Figure 3:
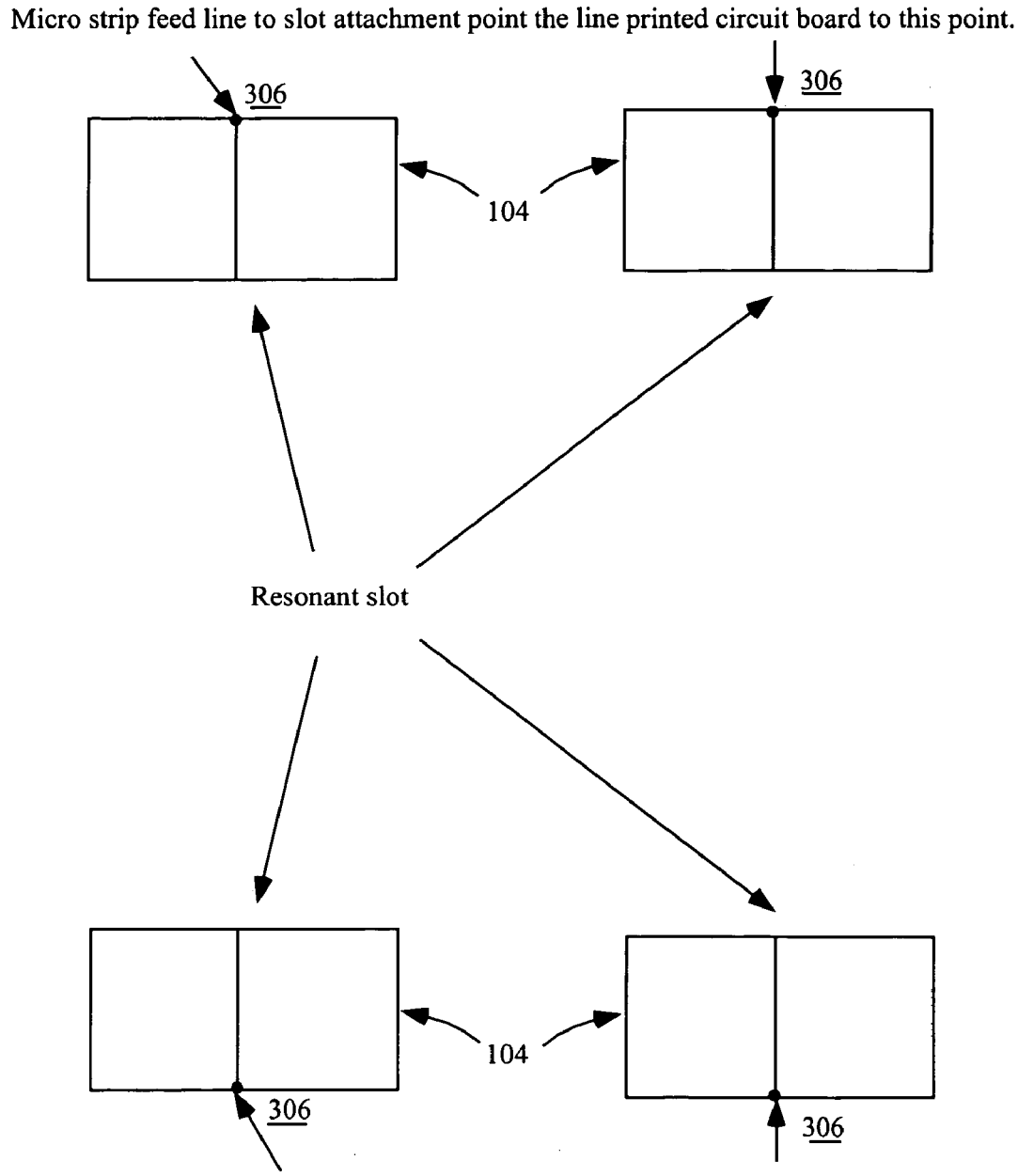
FIG. 3 illustrates micro feed line coupling to resonant slots in accordance with a preferred embodiment.

Referring now to FIG. 3, micro feed line coupling points 306 are illustrated. These coupling points 306 are at the centers of long edges of the resonant slots 104. The microstrip feed lines 212 cross the short dimensions of the slots 104. As FIG. 3 is only for illustration, only the slots 104, microstrip feed lines 212 and connections points 306 are shown. The connections 306 of the two slots 104 in the lower half of the antenna of FIG. 3 are at the lower long edges of the slots 104. In FIG. 2, they were shown connected to the upper long edges of the slots 104. The microstrip feed line connections to the two slots in the upper half of the antenna could also be to the lower edges of the slots 104. Moreover, the slots 104 and microstrip feed lines 212 could be rotated ninety degrees, or another arbitrary number of degrees, or only the slots may be rotated, or only the microstrip feed lines 212 may be rotated.

Figure 4:
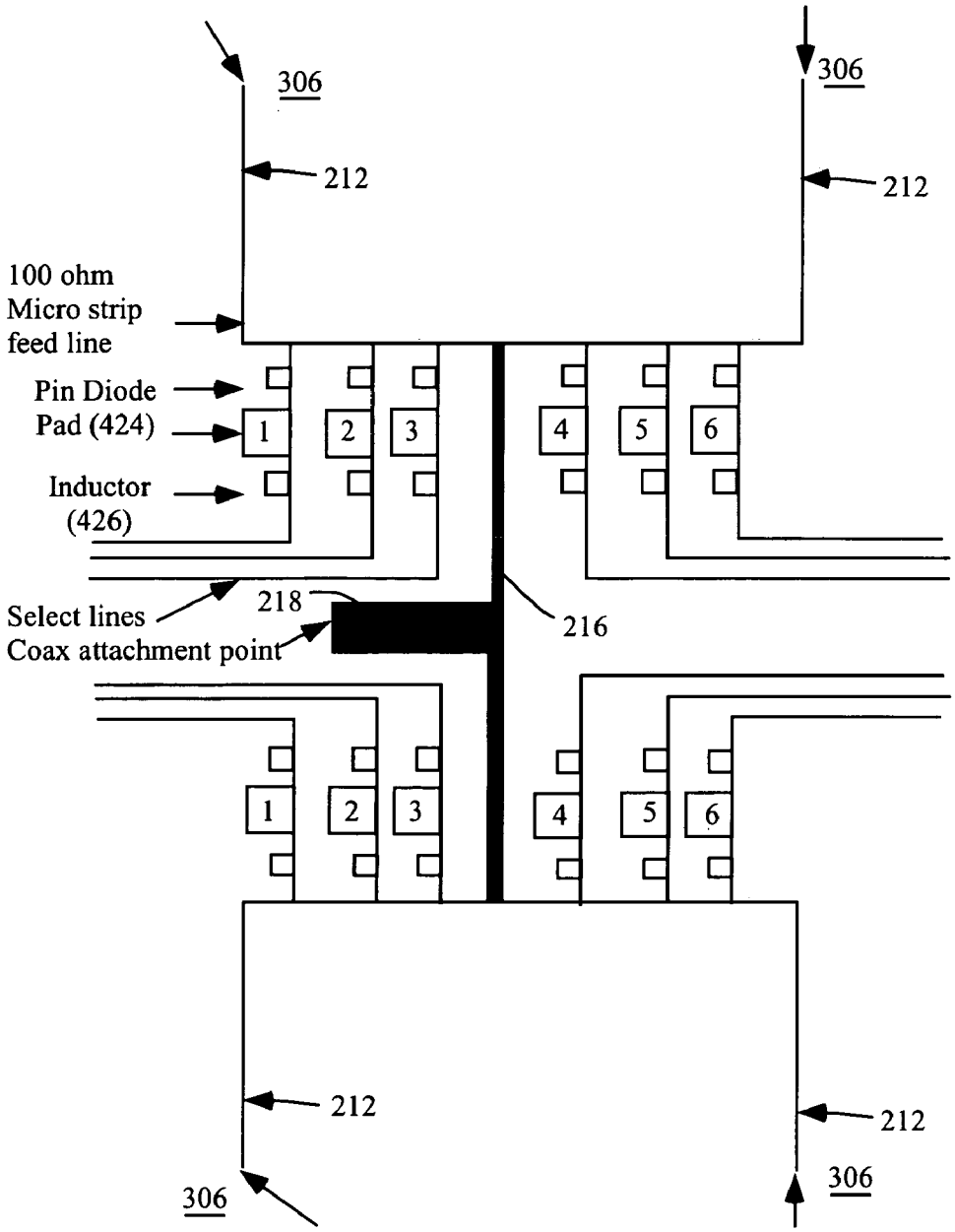
FIG. 4 schematically illustrates delay electronics coupled with microstrip feed lines for steering a phased array antenna in accordance with a preferred embodiment.

FIG. 4 schematically illustrates the delay electronics 214 coupled with the microstrip feed lines 212 for steering the phased array antenna in accordance with a preferred embodiment. Each of the microstrip feed lines 212 is shown in FIG. 4 coupled with three groups of electronics including a pin diode pad 424 and an inductor 426. The delay pads 424 are enabled and disabled by a voltage of +5 Volts and −5 Volts respectively on select lines.

Figure 5A:
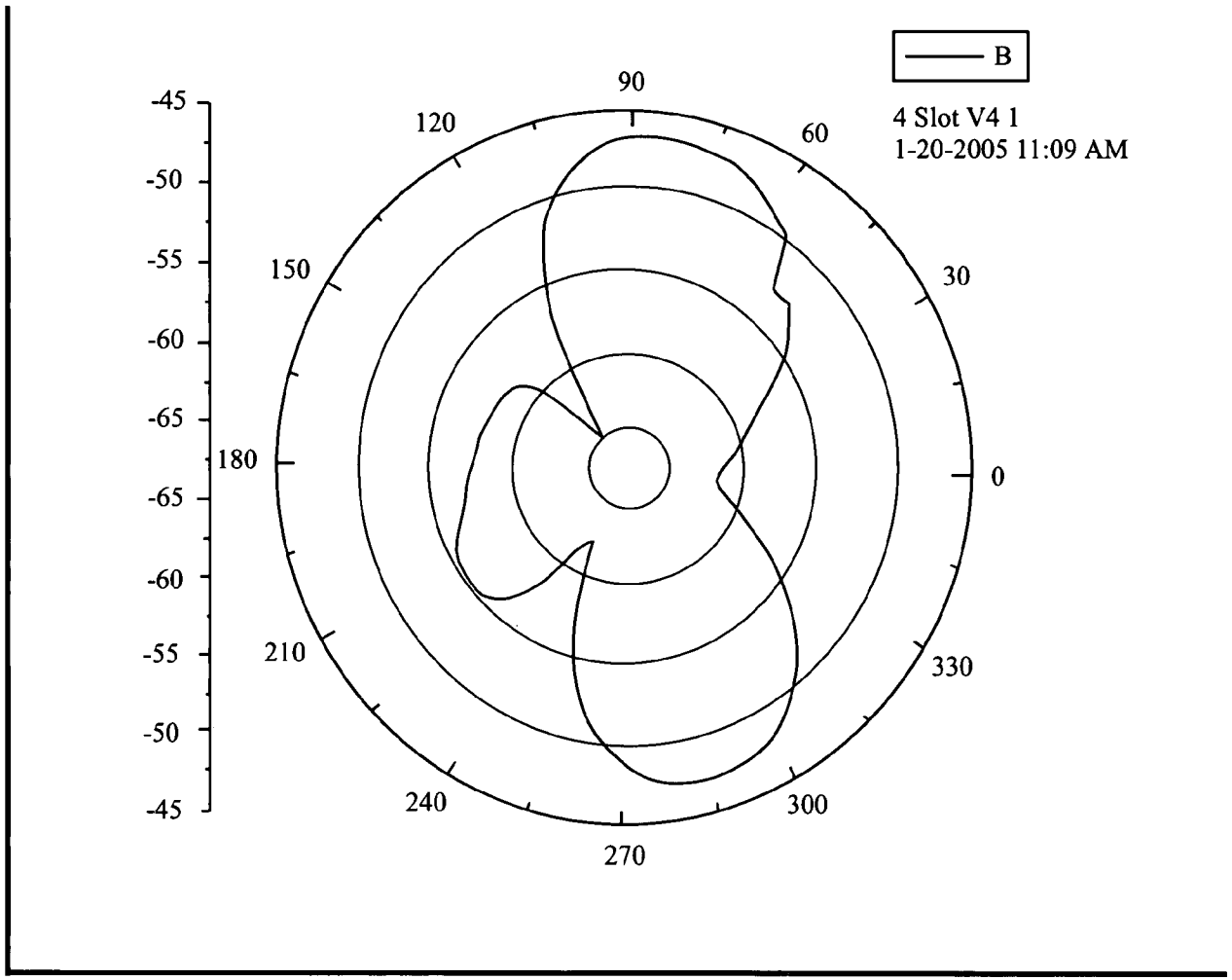
FIGS. 5A–5D show exemplary signal distribution plots in various directions based on selections of different lobes in accordance with a preferred embodiment.
Figure 5B:
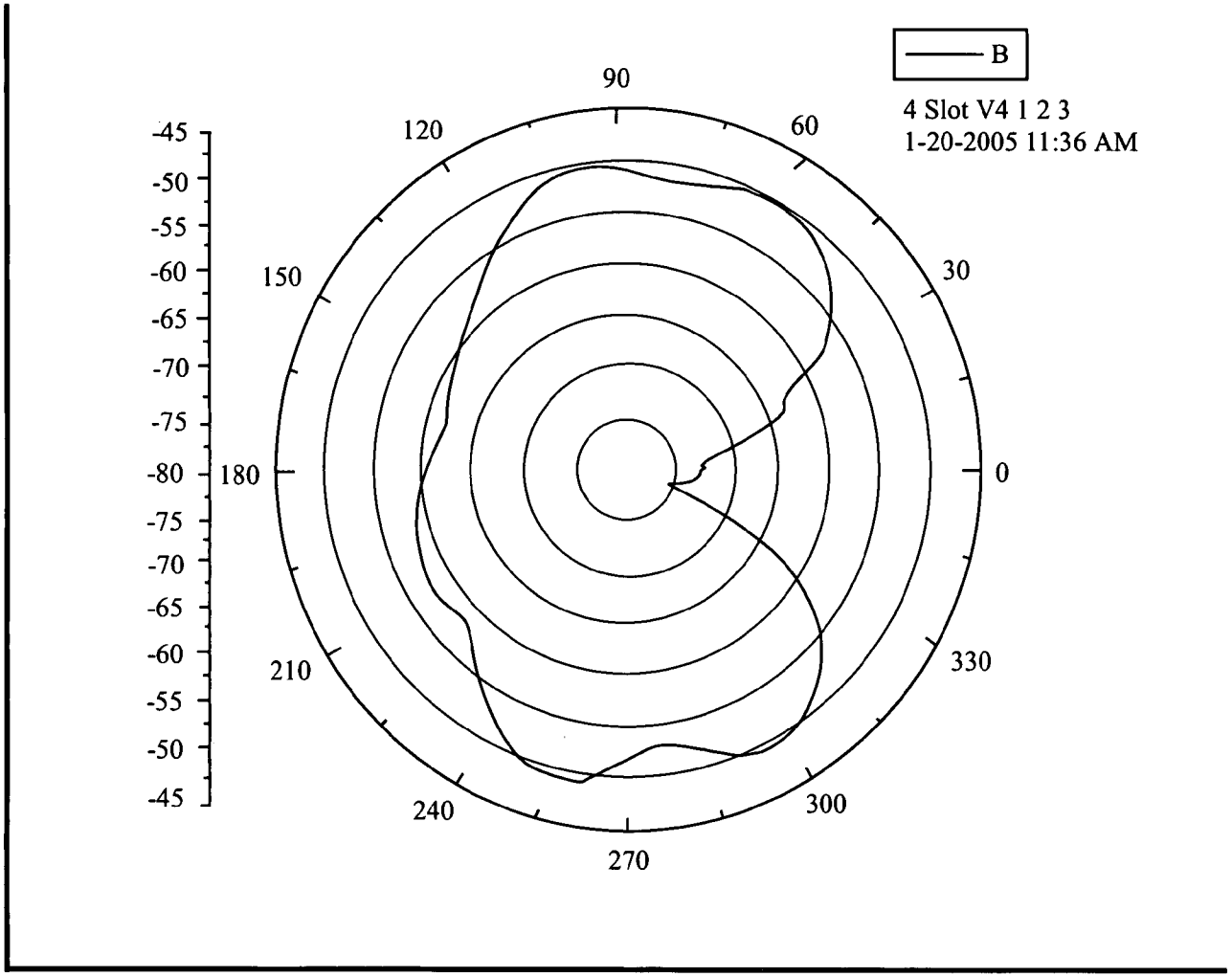
Figure 5C:
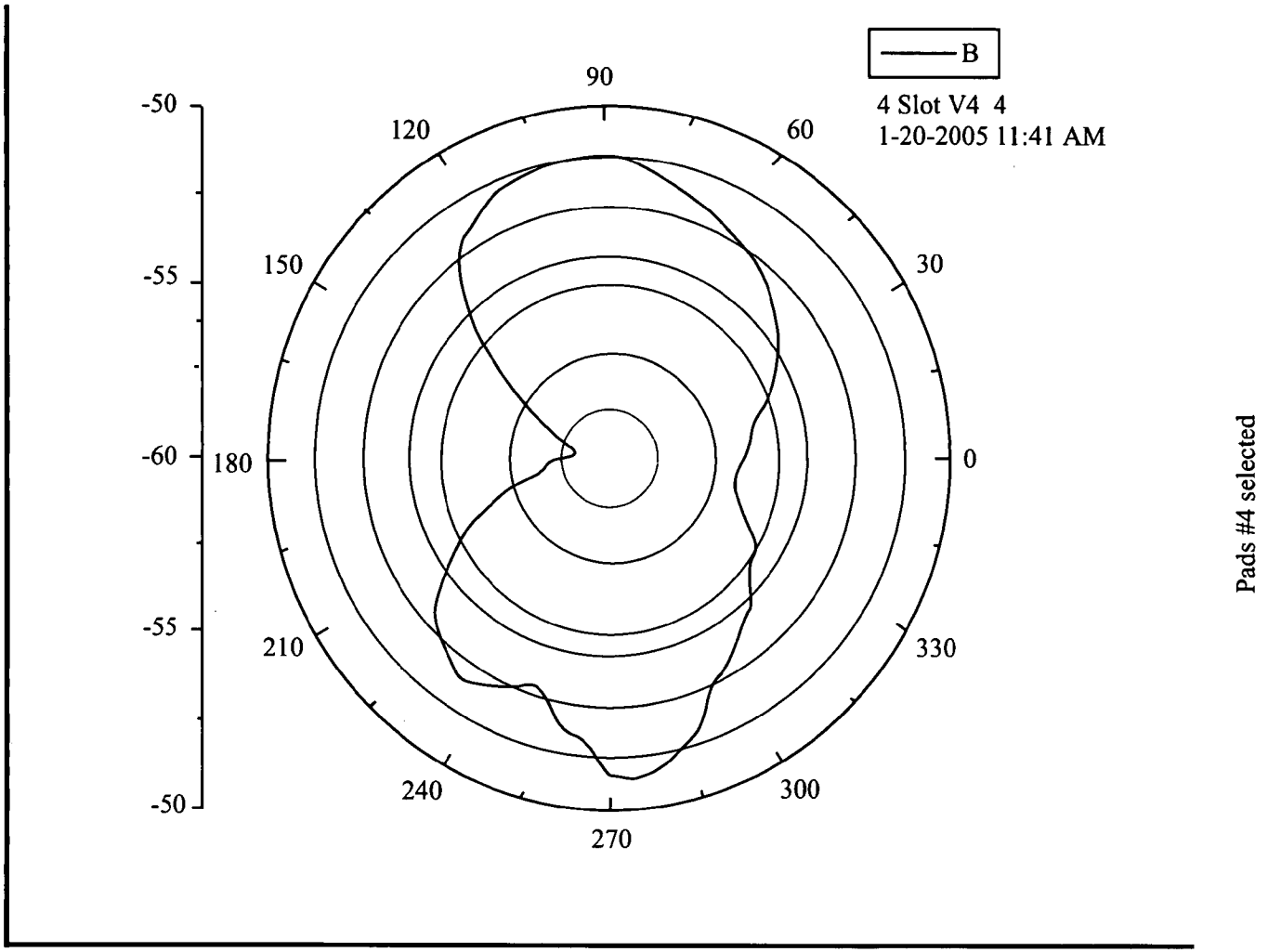
Figure 5D:
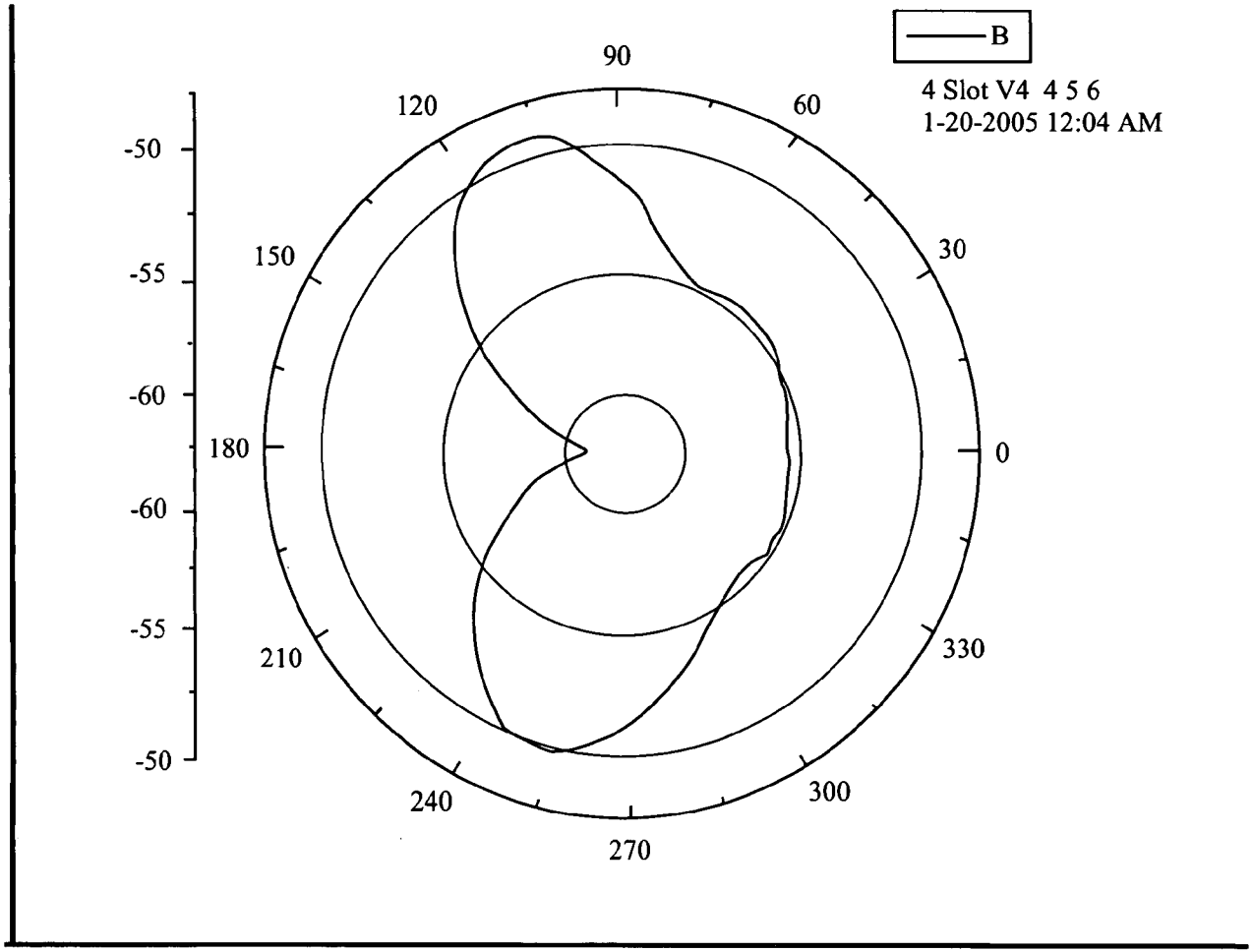

FIGS. 5A–5D show exemplary signal distribution plots in various directions based on selections of different lobes in accordance with a preferred embodiment. The pads illustrated in FIG. 4 are labeled one through six, or pads #1, #2, #3, #4, #5 and #6. The signal distribution plots were generated based on selectively turning on certain of pads #1–#6. FIG. 5A illustrates a signal distribution of the antenna when only pad #1 is selected. FIG. 5B illustrates a signal distribution of the antenna when pads #1, #2 and #3 are each selected. FIG. 5C illustrates a signal distribution of the antenna when only pad #4 is selected. FIG. 5D illustrates a signal distribution of the antenna when pads #4, #5 and #6 are each selected.

Figure 6:
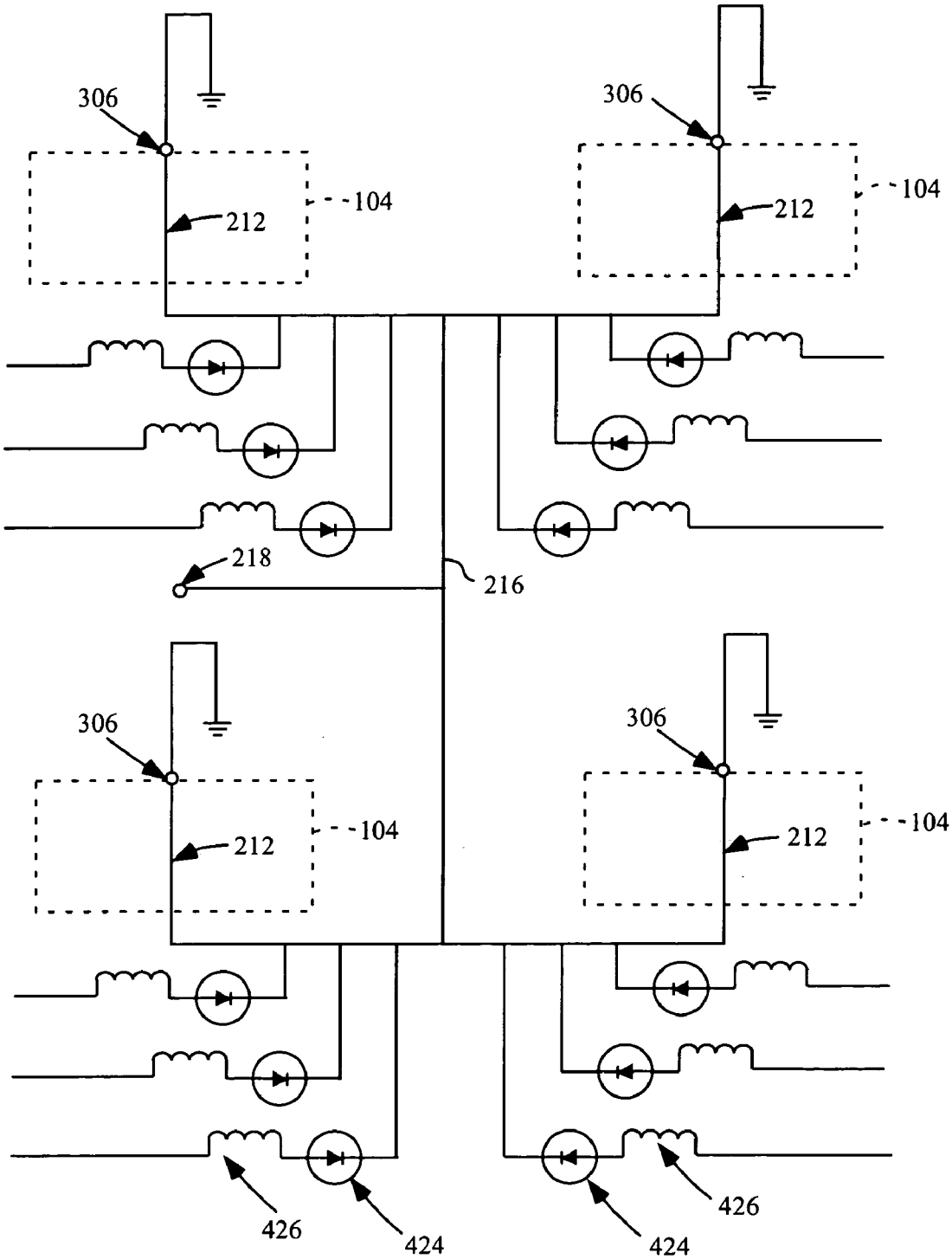
FIG. 6 schematically illustrates an electronic component representations of elements of a phased array antenna in accordance with a preferred embodiment.

FIG. 6 schematically illustrates an electronic component representations of elements of a phased array antenna in accordance with a preferred embodiment. The slots 104, microstrip feed lines 212, main feed line 216, coax attachment point 218 and microstrip feed line attachments points 306 are each shown and are preferably as described above. The microstrip feed line attachment points 306 are preferably grounded as illustrated in FIG. 6. The pin diode pads 424 and inductors 426 are illustrated with their common electrical representations.

Figure 7:
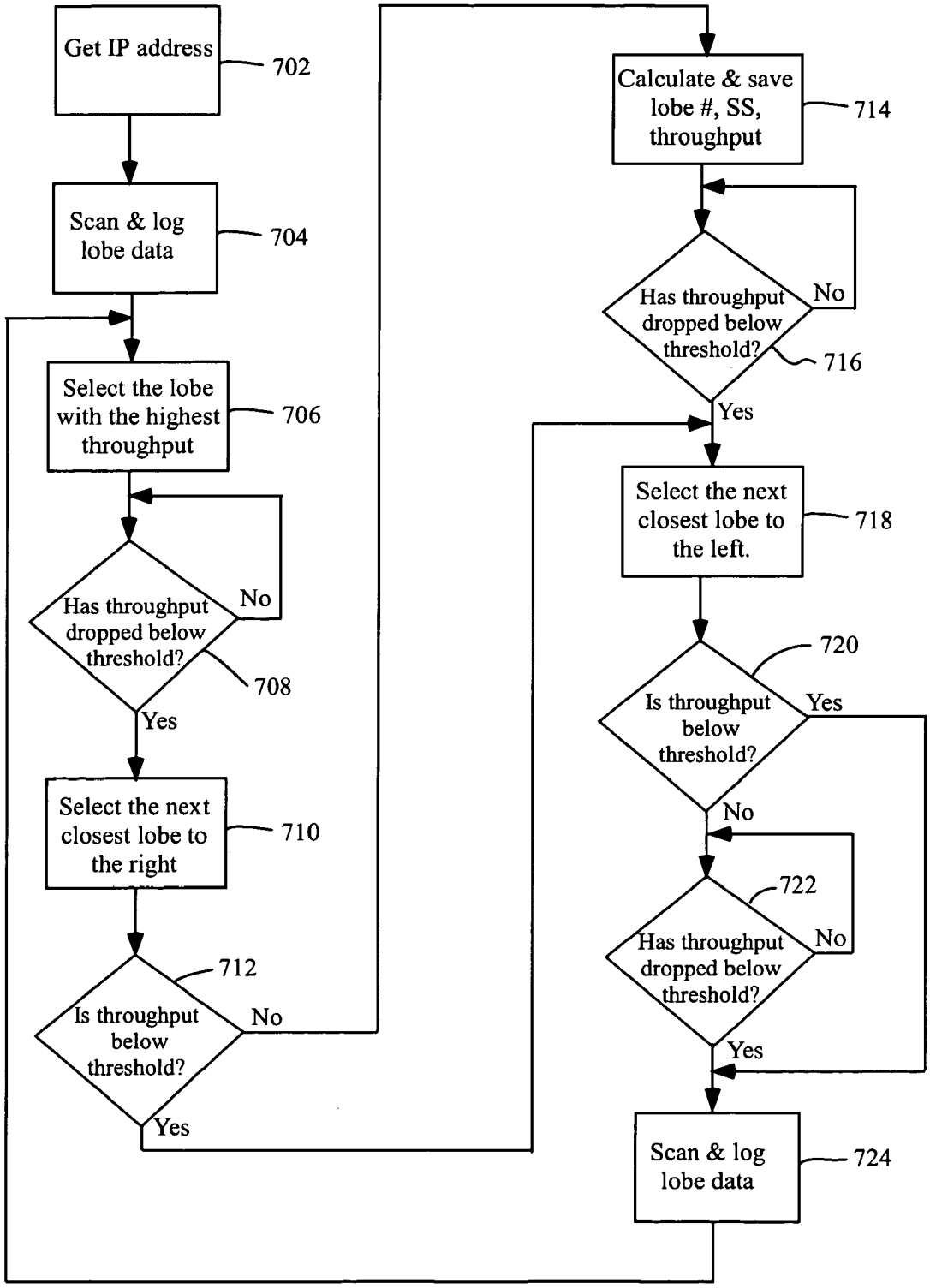
FIGS. 7–8 are a flow diagram of operations performed for selecting a signal distribution lobe of a phased array antenna in accordance with a preferred embodiment.
Figure 8:
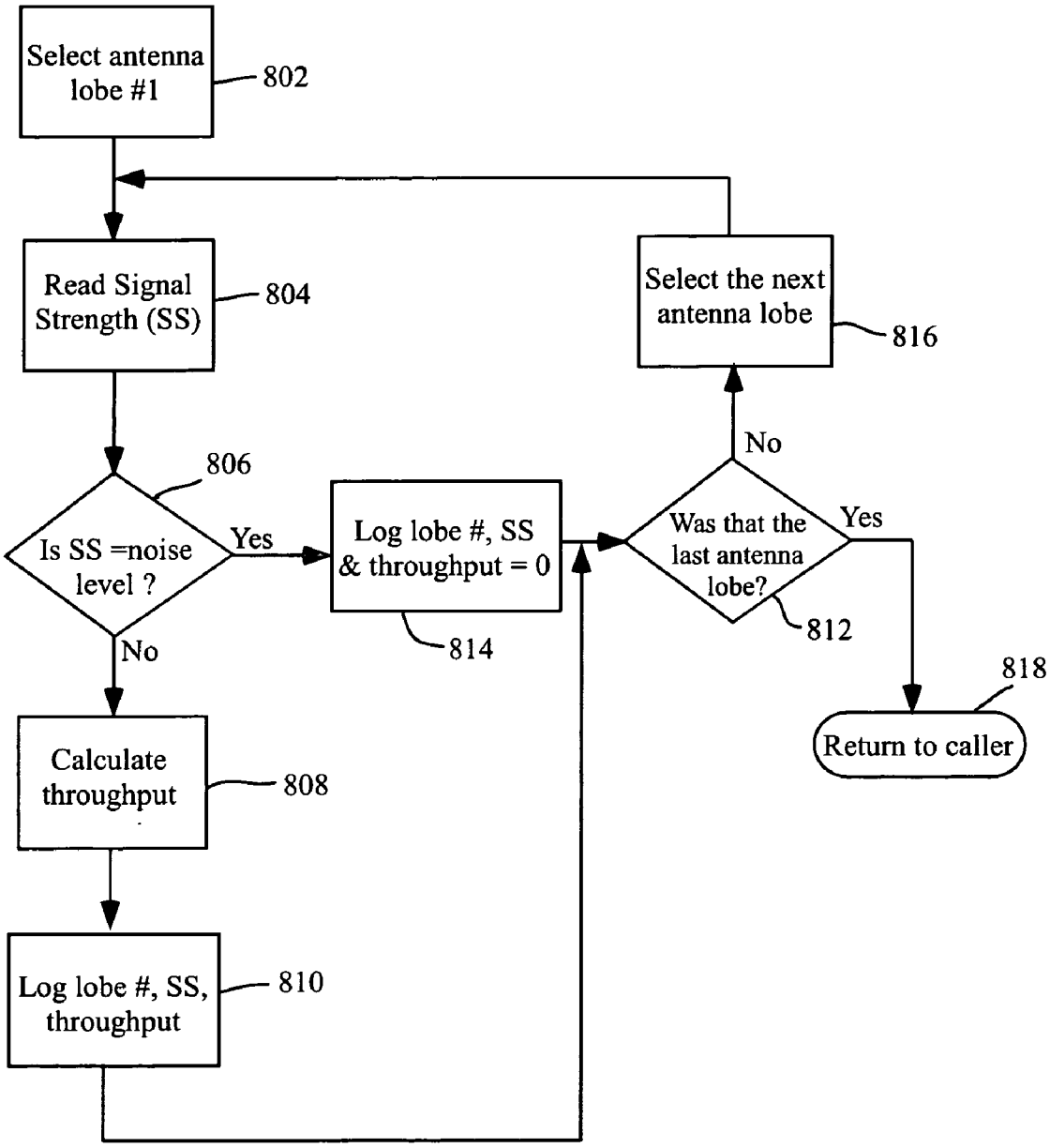

FIGS. 7–8 are a flow diagram of operations performed for selecting signal distribution lobes based on monitoring the throughput of lobes of a phased array antenna in accordance with a preferred embodiment. Although two lobes or more than three lobes may be available, the example process of FIG. 7 assumes three lobes for illustration. At 702, the IP address of a connected wireless device is obtained. The lobe data is scanned and logged for this connection to the antenna. Of the lobes that may be selected, the lobe with the highest throughput is selected. Throughput is the speed at which a wireless network processes data end to end per unit time. Typically measured in mega bits per second (Mbps). In this example, it will be assumed the middle of three lobes is selected.

This lobe is maintained as the selected lobe as long as the throughput remains above a threshold level. The threshold level may be a predetermined throughput level, or a predetermined throughput or percentage of throughput below a maximum, average or pre-set throughput level, or may be based on a comparison with other throughputs. At FIG. 8, which will be described in detail further below, if a signal strength falls to a noise level or within a certain amount of percentage of a noise level, then this fallen signal strength is used to determine when to select another lobe. The throughput is monitored according to the process of FIG. 7 continuously or periodically at 708. The process remains at 708 performing this monitoring unless it is determined that the throughput has dropped below the threshold level. Then at 710 another is lobe is selected such as the next closest lobe to the right. It is determined at 712 whether the throughput with this lobe is above or below the threshold. If the throughput with this new lobe is above the threshold, then the process moves to 714. At 714, the lobe number and signal strength of the new lobe and/or other data are saved. Now, the monitoring at 716 will go on with the new lobe as it did at 708 with the initial lobe. That is, the process will periodically or continuously monitor the throughput of the connection with the new lobe. The process moves to 718 only when the throughput with the new lobe is determined at 716 to be below the threshold level. Referring back to 712, if the throughput with the new lobe is determined there to be below the threshold, then the process moves directly to 718. At 718, yet another lobe, a third lobe, is selected such as the closest lobe to the left of the initial lobe. It is determined at 720 whether the throughput is above or below the threshold. If it is above the threshold, then this lobe will remain the selected lobe unless and until the throughput falls below the threshold. If the throughput does drop below the threshold, then at 724 lobe data is scanned and logged, and the process returns to 706 to select the highest throughput lobe again.

The process at FIG. 8 illustrates monitoring of the signal strengths and other data of all of the lobes according to a further embodiment, e.g., to select the strongest lobe. Referring now to FIG. 8, lobe #1, e.g., is selected at 802. The signal strength of the connection of a wireless device is read at 804. If the signal strength is determined to be above a noise level, or alternatively if the signal strength is above some predetermined amount or percentage above the noise level, then the throughput is calculated at 808. The lobe number, signal strength and throughput are logged at 810 and the process moves to 812. If at 806, the signal strength is determined to be at a noise level or at or below a predetermined amount or percentage above the noise level, then the lobe number, signal strength and throughput (equal to 0) are logged at 814 and the process moves to 814.

At 812, it is determined whether the data regarding the last lobe has been processed. If it has not, then the process returns to 804 to perform the monitoring for the next lobe. If the lobe data for all of the lobes has been monitored and determined, then the process returns to caller at 818.

The present invention has been described above with reference to a preferred embodiment. However, those skilled in the art having read this disclosure will recognize that changes and modifications may be made to the preferred embodiment without departing from the scope of the present invention. These and other changes or modifications are intended to be included within the scope of the present invention, as expressed in the following claims.

In addition, in methods that may be performed according to preferred embodiments and that may have been described above, and/or as recited in the claims below, the operations have been described above and/or recited below in selected typographical sequences. However, the sequences have been selected and so ordered for typographical convenience and are not intended to imply any particular order for performing the operations.

What is claimed is:

1. A high gain, steerable phased array antenna, comprising:

(a) a conducting sheet having multiple slots defined therein;

(b) for each of the slots, an electrical microstrip feed line electrically-connected to the conducting sheet on at least one side of the slot, wherein the microstrip feed lines and corresponding slots form magnetically coupled LC resonance elements;

(c) a main feed line coupling with the microstrip feed lines;

(d) delay circuitry for electronically steering the antenna by selectively changing signal phases on the microstrip feed lines; and (e) one or more processors operating based on program code that continuously or periodically determines a preferred signal direction and controls the delay circuitry to steer the antenna in the preferred direction.

2. The antenna of claim 1, wherein the slots have an oblong shape.

3. The antenna of claim 2, wherein the microstrip feed lines extend in the short dimensions of the oblong slots.

4. The antenna of claim 1, wherein the slots have a rectangular shape.

5. The antenna of claim 4, wherein the microstrip feed lines extend in the short dimensions of the rectangular slots.

6. The antenna of claim 1, wherein the delay circuitry comprises a pin diode and one or more pads cut into the plane of a circuit board also containing the microstrip feed lines.

7. The antenna of claim 6, wherein the delay circuitry comprises multiple pads that can be selectively added and subtracted for adding and subtracting delay, respectively.

8. The antenna of claim 6, wherein the delay circuitry further comprises one or more inductors.

9. The antenna of claim 1, wherein the main feed line couples with a coax cable connector attachment.

10. The antenna of claim 1, wherein the slots are fed in parallel by the microstrip feed lines.

11. The antenna of claim 1, wherein the preferred signal direction is determined based on a directional throughput determination.

12. The antenna of claim 1, wherein the preferred signal direction is determined based on directional determinations of combinations of signal strength and throughput.

13. The antenna of claim 1, wherein an equal number of slots are disposed on either side of the main feed line which is center fed with a coax cable connector attachment, thereby providing two halves of the main feed line.

14. The antenna of claim 13, wherein each half of the main feed line has the same resistance, which is also the same total resistance as the parallel combination of the microstrip feed lines that correspond to that half of the main feed line.

15. The antenna of claim 14, wherein the input impedance of the antenna is selected to be the same resistance as said halves of the main feed line.

16. The antenna of claim 1, wherein the antenna signal comprises multiple discreet lobes extending in different directions away from the antenna, and wherein a particular lobe is selected by controlling the delays to the slots.

17. The antenna of claim 16, wherein the selection of the particular lobe is based on a determination of throughputs of different lobes.

18. The antenna of claim 17, wherein the throughput determination comprises monitoring the throughput of an initial selected lobe, and when the throughput drops below a threshold value, or drops more than a predetermined percentage amount, or becomes less than a predetermined amount above a noise level, or combinations thereof, then changing to an adjacent lobe and similarly monitoring its throughput.

19. The antenna of claim 18, wherein when the adjacent lobe is determined to have a throughput that is below a threshold value, or is at least a predetermined percentage amount below a maximum level, or is less than a predetermined amount above a noise level, or combinations thereof, then changing to the other adjacent lobe on the opposite side of the initial selected lobe.

20. The antenna of claim 17, wherein the throughput determination comprises scanning through and determining the throughputs of all of the lobes; the lobe with the highest throughput being selected.

21. A method of operating a high gain, steerable phased array antenna, comprising:

(a) providing the antenna including:
  (i) multiple slots;
  (ii) for each of the slots, an electrical microstrip feed line electrically-connected to the conducting sheet on at least one side of the slot, wherein the microstrip feed lines and corresponding slots form magnetically coupled LC resonance elements;
  (iii) a main feed line coupling with the microstrip feed lines,
  (iv) delay circuitry coupled with the microstrip feed lines;
  (v) one or more processors operating based on program code for controlling the antenna;
(b) electronically steering the antenna by controlling the delay circuitry;
(c) continuously or periodically determining a preferred signal direction; and
(d) controlling the delay circuitry to selectively change signal phases on the microstrip feed lines and thereby steer the antenna in the preferred direction.

22. The method of claim 21, further comprising feeding the slots in parallel by the microstrip feed lines.

23. The method of claim 21, wherein the determining of the preferred signal direction is based on a directional determination of combinations of signal strength and throughput.

24. The method of claim 21, wherein the determining of the preferred signal direction is based on a directional determination of signal throughputs.

25. The method of claim 24, wherein the antenna signal comprises multiple discreet lobes extending in different directions away from the antenna, and wherein the steering comprises selecting a particular lobe by controlling the delays to the slots based on a comparison of throughputs of different lobes.

26. The method of claim 25, wherein the throughput determination comprises scanning through and determining the throughputs of all of the lobes; the lobe with the highest throughput being selected.

27. The method of claim 24, wherein the antenna signal comprises multiple discreet lobes extending in different directions away from the antenna, and wherein the steering comprises selecting a particular lobe by controlling the delays to the slots based on monitoring the throughput of an initial selected lobe, and when the throughput drops below a threshold value, or drops more than a predetermined percentage amount, or becomes less than a predetermined amount above a noise level, or combinations thereof, then changing to an adjacent lobe and similarly monitoring its throughput.

28. The method of claim 27, wherein when the adjacent lobe is determined to have a throughput that is below a predetermined level, or is at least a predetermined percentage amount below a maximum level, or is less than a predetermined amount above a noise level, or combinations thereof, then changing to the other adjacent lobe on the opposite side of the initial selected lobe.

29. The method of claim 21, wherein the slots have an oblong shape.

30. The method of claim 29, wherein the microstrip feed lines extend in the short dimensions of the oblong slots.

31. The method of claim 21, wherein the slots have a rectangular shape.

32. The method of claim 31, wherein the microstrip feed lines extend in the short dimensions of the rectangular slots.

33. A high gain, steerable phased array antenna, comprising:

(a) multiple resonant elements;
(b) a main feed coupling with the resonant elements;
(c) electronics for steering the antenna by providing different inputs to the resonant elements; and
(d) one or more processors operating based on program code that continuously or periodically determine a preferred signal direction based on a directional throughput determination, and control the electronics to steer the antenna in the preferred direction, wherein the antenna signal comprises multiple discreet lobes extending in different directions away from the antenna, and wherein a particular lobe is selected by controlling the electronics.

34. The antenna of claim 33, wherein the preferred signal direction is determined based on a directional determination of combinations of signal strength and throughput.

35. The antenna of claim 33, wherein the selection of the particular lobe is based on the directional throughput determination.

36. The antenna of claim 35, wherein the directional throughput determination comprises monitoring the throughput of an initial selected lobe, and when the throughput drops below a threshold value, or drops a predetermined percentage amount, or becomes below a predetermined amount above a noise level, or combinations thereof, then changing to an adjacent lobe and similarly monitoring its throughput.

37. The antenna of claim 36, wherein when the adjacent lobe is determined to have a throughput that is below a threshold value, or is at least a predetermined percentage amount below a maximum level, or is below a predetermined amount above a noise level, or combinations thereof, then changing to the other adjacent lobe on the opposite side of the initial selected lobe.

38. The antenna of claim 35, wherein the directional throughput determination comprises scanning through and determining the throughputs of all or multiple ones of the lobes; the lobe with the highest throughput being selected.

39. The antenna of claim 33, wherein the resonant elements have an oblong shape.

40. The antenna of claim 39, wherein the microstrip feed lines extend in the short dimensions of the oblong resonant elements.

41. The antenna of claim 33, wherein the resonant elements have a rectangular shape.

42. The antenna of claim 41, wherein the microstrip feed lines extend in the short dimensions of the rectangular resonant elements.

43. A method of operating a high gain, steerable phased array antenna, comprising:

(a) providing the antenna including:

(i) multiple resonant elements;

(ii) a main feed coupling with the resonant elements;

(iii) electronics for steering the antenna by providing different inputs to the resonant elements, (iv) one or more processors operating based on program code for controlling the antenna;

(b) electronically steering the antenna by controlling the electronics;

(c) continuously or periodically determining a preferred signal direction based on a directional throughput determination; and (d) adjusting the direction of the antenna as the preferred direction changes, wherein the antenna signal comprises multiple discreet lobes extending in different directions away from the antenna, and wherein the steering comprises selecting a particular lobe by controlling the electronics based on a comparison of throughputs of different lobes.

44. The method of claim 43, wherein the determining of the preferred signal direction is based on a combination of signal strength and throughput.

45. The method of claim 43, wherein the directional throughput determination comprises scanning through and determining the throughputs of all or multiple ones of the lobes; the lobe with the highest throughput being selected.

46. The method of claim 43, wherein the resonant elements have an oblong shape.

47. The method of claim 46, wherein the microstrip feed lines extend in the short dimensions of the oblong resonant elements.

48. The method of claim 43, wherein the resonant elements have a rectangular shape.

49. The method of claim 48, wherein the microstrip feed lines extend in the short dimensions of the rectangular resonant elements.

50. A method of operating a high gain, steerable phased array antenna, comprising:

(a) providing the antenna including:

(i) multiple resonant elements;

(ii) a main feed coupling with the resonant elements;

(iii) electronics for steering the antenna by providing different inputs to the resonant elements, (iv) one or more processors operating based on program code for controlling the antenna;

(b) electronically steering the antenna by controlling the electronics;

(c) continuously or periodically determining a preferred signal direction based on a directional throughput determination; and (d) adjusting the direction of the antenna as the preferred direction changes, wherein the antenna signal comprises multiple discreet lobes extending in different directions away from the antenna, and wherein the steering comprises selecting a particular lobe by controlling the electronics based on monitoring the throughput of an initial selected lobe, and when the throughput drops below a threshold value, or drops a predetermined percentage amount, or becomes below a predetermined amount above a noise level, or combinations thereof, changing to an adjacent lobe and similarly monitoring its throughput.

51. The method of claim 50, wherein when the adjacent lobe is determined to have a throughput that is below a threshold value, or is at least a predetermined percentage amount below a maximum level, or is below a predetermined amount above a noise level, or combinations thereof, then changing to the other adjacent lobe on the opposite side of the initial selected lobe.

52. One or more processor readable storage devices having processor readable code embodied thereon, said processor readable code for programming one or more processors to perform a method of operating a high gain, steerable phased array antenna, the method comprising:

(a) providing the antenna including:

(i) multiple slots;

(ii) for each of the slots, an electrical microstrip feed line for each of the slots, an electrical microstrip feed line electrically-connected to the conducting sheet on at least one side of the slot, wherein the microstrip feed lines and corresponding slots form magnetically coupled LC resonance elements;

(iii) a main feed line coupling with the microstrip feed lines, (iv) delay circuitry coupled with the microstrip feed lines;

(v) one or more processors operating based on program code for controlling the antenna;

(b) electronically steering the antenna by controlling the delay circuitry;

(c) continuously or periodically determining a preferred signal direction; and (d) controlling the delay circuitry to selectively change signal phases on the microstrip feed lines and thereby steer the antenna in the preferred direction.

53. The one or more storage devices of claim 52, the method further comprising feeding the slots in parallel by the microstrip feed lines.

54. The one or more storage devices of claim 52, wherein the determining of the preferred signal direction is based on a directional determination of combinations of signal strength and throughput.

55. The one or more storage devices of claim 52, wherein the determining of the preferred signal direction is based on a directional determination of signal throughputs.

56. The one or more storage devices of claim 55, wherein the antenna signal comprises multiple discreet lobes extending in different directions away from the antenna, and wherein the steering comprises selecting a particular lobe by controlling the delays to the slots based on a comparison of throughputs of different lobes.

57. The one or more storage devices of claim 56, wherein the throughput determination comprises scanning through and determining the throughputs of all of the lobes; the lobe with the highest throughput being selected.

58. The one or more storage devices of claim 55, wherein the antenna signal comprises multiple discreet lobes extending in different directions away from the antenna, and wherein the steering comprises selecting a particular lobe by controlling the delays to the slots based on monitoring the throughput of an initial selected lobe, and when the throughput drops below a threshold value, or drops more than a predetermined percentage amount, or becomes less than a predetermined amount above a noise level, or combinations thereof, then changing to an adjacent lobe and similarly monitoring its throughput.

59. The one or more storage devices of claim 58, wherein when the adjacent lobe is determined to have a throughput that is below a predetermined level, or is at least a predetermined percentage amount below a maximum level, or is less than a predetermined amount above a noise level, or combinations thereof, then changing to the other adjacent lobe on the opposite side of the initial selected lobe.

60. The one or more storage devices of claim 52, wherein the slots have an oblong shape.

61. The one or more storage devices of claim 60, wherein the microstrip feed lines extend in the short dimensions of the oblong slots.

62. The one or more storage devices of claim 52, wherein the slots have a rectangular shape.

63. The one or more storage devices of claim 62, wherein the microstrip feed lines extend in the short dimensions of the rectangular slots.

64. One or more processor readable storage devices having processor readable code embodied thereon, said processor readable code for programming one or more processors to perform a method of operating a high gain, steerable phased array antenna, the method comprising:

(a) providing the antenna including:
- (i) multiple resonant elements;
- (ii) a main feed coupling with the resonant elements;
- (iii) electronics for steering the antenna by providing different inputs to the resonant elements,
- (iv) one or more processors operating based on program code for controlling the antenna;

(b) electronically steering the antenna by controlling the electronics;

(c) continuously or periodically determining a preferred signal direction based on a directional throughput determination; and (d) adjusting the direction of the antenna as the preferred direction changes, wherein the antenna signal comprises multiple discreet lobes extending in different directions away from the antenna, and wherein the steering comprises selecting a particular lobe by controlling the electronics based on a comparison of throughputs of different lobes.

65. The one or more storage devices of claim 64, wherein the determining of the preferred signal direction is based on a combination of signal strength and throughput.

66. The one or more storage devices of claim 64, wherein the directional throughput determination comprises scanning through and determining the throughputs of all or multiple ones of the lobes; the lobe with the highest throughput being selected.

67. The one or more storage devices of claim 64, wherein the resonant elements have an oblong shape.

68. The one or more storage devices of claim 67, wherein the microstrip feed lines extend in the short dimensions of the oblong resonant elements.

69. The one or more storage devices of claim 67, wherein the resonant elements have a rectangular shape.

70. The one or more storage devices of claim 69, wherein the microstrip feed lines extend in the short dimensions of the rectangular resonant elements.

71. One or more processor readable storage devices having processor readable code embodied thereon, said processor readable code for programming one or more processors to perform a method of operating a high gain, steerable phased array antenna, the method comprising:

(a) providing the antenna including:
- (i) multiple resonant elements;
- (ii) a main feed coupling with the resonant elements;
- (iii) electronics for steering the antenna by providing different inputs to the resonant elements,
- (iv) one or more processors operating based on program code for controlling the antenna;

(b) electronically steering the antenna by controlling the electronics;

(c) continuously or periodically determining a preferred signal direction based on a directional throughput determination; and (d) adjusting the direction of the antenna as the preferred direction changes, wherein the antenna signal comprises multiple discreet lobes extending in different directions away from the antenna, and wherein the steering comprises selecting a particular lobe by controlling the electronics based on monitoring the throughput of an initial selected lobe, and when the throughput drops below a threshold value, or drops a predetermined percentage amount, or becomes below a predetermined amount above a noise level, or combinations thereof, changing to an adjacent lobe and similarly monitoring its throughput.

72. The one or more storage devices of claim 71, wherein when the adjacent lobe is determined to have a throughput that is below a threshold value, or is at least a predetermined percentage amount below a maximum level, or is below a predetermined amount above a noise level, or combinations thereof, then changing to the other adjacent lobe on the opposite side of the initial selected lobe.

73. A high gain, phased array antenna, comprising:

(a) a conducting sheet having a number of one or more slots defined therein;

(b) for each of the slots, an electrical microstrip feed line for each of the slots, an electrical microstrip feed line electrically-connected to the conducting sheet on at least one side of the slot, wherein the microstrip feed lines and corresponding slots form magnetically coupled LC resonance elements; and (c) a main feed line coupling with the microstrip feed lines.

74. The antenna of claim 73, wherein the slots have an oblong shape.

75. The antenna of claim 74, wherein the microstrip feed lines extend in the short dimensions of the oblong slots.

76. The antenna of claim 73, wherein the slots have a rectangular shape.

77. The antenna of claim 76, wherein the microstrip feed lines extend in the short dimensions of the rectangular slots.

78. The antenna of claim 73, wherein the main feed line couples with a coax cable attachment.

79. The antenna of claim 73, wherein the slots are fed in parallel by the microstrip feed lines.

80. The antenna of claim 73, wherein the number of slots equals two or four, and wherein one or two slots, respectively, are disposed on each side of the main feed line which is center fed with a coax cable attachment, thereby providing two halves of the main feed line.

81. The antenna of claim 80, wherein each half of the main feed line has the same resistance, which is also the same total resistance as the parallel combination of the microstrip feed lines that correspond to that half of the main feed line.

82. The antenna of claim 81, wherein the input impedance of the antenna is selected to be the same resistance as said halves of the main feed line.

83. The antenna of claim 73, wherein the antenna signal comprises one or more discreet lobes extending away from the antenna.

84. The antenna of claim 73, wherein the number of slots equals one which is fed with a coax cable attachment.

85. The antenna of claim 84, wherein the input impedance of the antenna is selected to be the same as the coax impedance.

86. The antenna of claim 84, wherein the antenna signal comprises one or more discreet lobes extending away from the antenna.

* * * * *